US005924569A

United States Patent [19]

Kleinschmit, Jr. et al.

[11] Patent Number: 5,924,569

[45] Date of Patent: Jul. 20, 1999

[54] FILAMENT TUBE SHIPPING APPARATUS

[75] Inventors: Edmund W. Kleinschmit, Jr., Kings Mountain, N.C.; Curtis F. Edwards, Jr., Columbia, S.C.; Gary N. Trotter, Huntersville, N.C.

[73] Assignee: Stone Container Corporation, Chicago, Ill.

[21] Appl. No.: 08/909,837

[22] Filed: Aug. 12, 1997

[51] Int. Cl.[6] ..... B65D 85/62; B65D 19/44

[52] U.S. Cl. ..... 206/394; 108/53.5; 206/386; 206/499; 206/509

[58] Field of Search ..... 206/392, 394, 206/391, 509, 386, 497, 499; 108/51.3, 53.5

[56] References Cited

U.S. PATENT DOCUMENTS

| | | | |
|---|---|---|---|
| 2,326,928 | 8/1943 | Courson | 206/394 X |
| 2,583,672 | 1/1952 | Storey | 206/392 X |
| 2,662,638 | 12/1953 | Storer et al. | 206/499 X |
| 2,699,866 | 1/1955 | Russell, Jr. | 206/392 |
| 2,706,593 | 4/1955 | Caraber | 206/392 X |
| 2,818,974 | 1/1958 | Talbot | 206/392 |
| 3,172,534 | 3/1965 | Martin | 206/392 |
| 3,227,272 | 1/1966 | Critzer | 206/392 |
| 3,258,116 | 6/1966 | Goerke | 206/392 |
| 3,285,412 | 11/1966 | Knight et al. | 206/392 |
| 3,392,827 | 7/1968 | Bogren | 206/392 |
| 3,621,995 | 11/1971 | Francis | 206/394 X |
| 4,998,619 | 3/1991 | Sowa et al. | 206/392 |

OTHER PUBLICATIONS

Ref. 3—Stone Container Corporation, disclosed/offered for sale at least as early as Jan. 1, 1996—copies of drawings for components of filament tube shipping apparatus.

Ref. 4—Bigelow Packaging, advertisement at least as early as Aug. 1, 1996—copy of magazine advertisement for molded plastic filament tube shipping apparatus.

Ref. 5—Southeast Packaging & Supply, Inc., copies of business card and copies of photos of plastic film wrapped, corrugated paperboard filament tube shipping apparatus, at least as early as Aug. 1, 1996.

Ref. 1—Stone Container Corporation, disclosed/offered for sale at least as early as Jan. 1, 1994—copies of photos of filament tube shipping apparatus.

Ref. 2—Stone Container Corporation, disclosed/offered for sale at least as early as May 1, 1994—copies of photos of filament tube shipping apparatus.

*Primary Examiner*—Bryon P. Gehman

*Attorney, Agent, or Firm*—Dick and Harris

[57] ABSTRACT

A filament tube shipping apparatus is provided for the facilitated packaging and transportation of large filament tube structures which have been wound with extended lengths of flexible materials like yarn. The filament tube shipping structure includes a pallet portion for facilitating handling of the filament tube structure by forklifts and the like. A plurality of spacer pad apparatus are provided for enabling the assembly and stacking of a plurality of layers of loaded filament tubes. The filament tube shipping apparatus facilitates the loading and wrapping of same by automated robotic equipment.

10 Claims, 11 Drawing Sheets

FILAMENT TUBE SHIPPING APPARATUS

BACKGROUND OF THE INVENTION

1. The Technical Field

The present invention relates to apparatus for the transportation, handling and/or temporary storage of loaded filament tubes or cones carrying wound materials such as yarn, thread, rope, wire and the like.

2. The Prior Art

The transportation and handling of filament materials which are carried by filament tubes or cones, such as thread, yarn, or wire, can often be problematic. The typical filament tube for holding a large quantity of a thread or yarn, for example, for textile manufacturing, is typically a cylindrical or conical tube several inches or more in length and possibly several inches in diameter, around which has been wound many yards of the filament, resulting in a loaded filament tube which may be up to one or two feet in diameter and have a height of up to a foot or more. The final configuration of the wound filament may be cylindrical or frusto-conical, usually reflecting the shape of the filament tube member.

Since the filament tube members typically extend both above and below the wound mass of line or thread, organized, stabilized handling and transportation of such loaded filament tubes can be difficult. This is particularly true since it is not economical to transport such loaded filament tubes unless done in large quantities. For example, a shipment may consist of 50 or 60 or more loaded filament tubes, which may contain filaments of the same type, size and color.

One known prior art method for packaging and transporting such filament tubes is to provide a preformed packaging system fabricated from molded plastic. A bottom pad member will be provided having a pattern of depressions or apertures formed in its upper surface, suitably configured for receiving the bottom ends of a plurality of filament tube members arranged in an array, e.g. 5×6, etc. Typically, the apertures will be sufficiently deep that the actual wound material may be able to rest on the surface of the bottom pad member, for added stability. Larger indentations, concentrically surrounding each of the smaller depressions or apertures, may be provided for receiving the bulk of the wound filament.

Typically, the bottom pad member will be tray-shaped (i.e., with definite side walls) and have pre-formed molded feet or pedestals, thus raising the surface of the bottom pad member above the ground, in order to enable the bottom pad member to also function as a pallet.

Once a first layer of loaded filament tubes has been laid down, a separator member is laid atop the bottom pad member. The separator member, also formed from molded plastic, will have suitably arranged depressions on its lower side for alignment with and receipt of the upper ends of the filament tube members. Suitably arranged depressions on the upper side of the separator member will receive the bottom ends of loaded filament tubes, in a manner similar to that previously described. This layering of separator members and loaded filament tubes is continued until a stack of loaded filament tubes is created. This stack may be as many as five to seven or more layers high.

A top cap member is then set on the uppermost layer of loaded filament tubes. Typically, the top cap member will be shaped like an inverted tray and have depressions on its underside for receiving the top ends of the filament tube members of the uppermost layer.

While such a packaging system utilizing pre-formed molded plastic members may enable the packaging and transportation of loaded filament tubes, such prior art packaging systems can often be expensive due to the cost of manufacture of such molded plastic members. In addition, to achieve the high strength required for the containment and transportation of an assembled package of stacked loaded filament tubes (which may have a total weight of several hundred to several thousand pounds), the packaging members themselves may be heavy and thus add to the overall gross weight of the package. If there are limitations on the gross weight of the completed package, the increased weight of the packaging members will detract from the available net weight of the loaded filament tubes.

In addition, the use of such plastic materials may be undesirable in view of environmental/recycling considerations. Further, such plastic formed members may become brittle over time and thus susceptible to breakage, requiring their replacement by further relatively expensive plastic packaging members. In addition, plastic packaging system components are typically returned to the shipper of the thread or yarn and reused. This can create problems of cost, due to the inefficient return shipping of the empty components, loss, breakage, cleaning and the added administrative personnel expenses to both the supplier and their customer(s).

Filament tube shipping apparatus fabricated from corrugated paperboard material are known. However, such structures included complex tray-shaped top and/or bottom cap structures which typically had to be erected by hand, prior to the actual packaging process. Complex blanks were needed for the cap structures, which, in turn, led to increased material costs, in addition to the increased time for assembly of the shipping structures. In addition, pallet structures were provided having bottom skid sheets which covered the entire bottom of the pallet structure. Such pallet structures involved increased weight, material cost, and would often became crumpled, torn or bent by straps used to hold the stack together, thus weakening the pallet structure and potentially producing instability. In general, such prior corrugated paperboard filament tube apparatus were generally unsuited for use with automated handling and packaging equipment.

It is an object of the present invention to provide a system for the packaging and transportation of large quantities of filament tubes loaded with wound filament material arranged in an array, which packaging system does not require use of molded plastic packaging members.

Another object of the present invention is to provide a system for the packaging and transportation of large quantities of filament tubes loaded with wound filament material arranged in an array, which may be more readily manufactured and which may be more readily recycled, than existing molded plastic packaging members.

Still another object of the present invention is to provide such a packaging system which has a substantially reduced weight relative to molded plastic packaging members.

Yet another object of the present invention is to provide a packaging system which has improved performance over prior corrugated paperboard packaging systems, and which is capable of use with automated handling and packaging systems.

A still further object of the present invention is to provide a packaging system which has improved characteristics over prior corrugated paperboard packaging systems, such as decreased usage of corrugated material, and simplified manufacture, assembly and handling.

These and other objects of the invention will become apparent in light of the present specification (including claims) and drawings.

SUMMARY OF THE INVENTION

The present invention is directed to a filament tube shipping apparatus, for the facilitated packaging and transportation of one or more filament tube members, having a quantity of elongated filament material wound thereon to form loaded filament tubes.

The filament tube shipping apparatus comprises a bottom pad member, having at least one aperture disposed therein, for enabling the lower end of at least one filament tube member of at least one loaded filament tube to be inserted therein, for enabling, in turn, at least one loaded filament tube to be placed in a stable resting position upon the bottom pad member.

At least one separator pad member is operably positionable upon at least one loaded filament tube. The at least one separator pad member may have at least one first aperture disposed therein for enabling the upper end of at least one filament tube member to be inserted therein, for enabling, in turn, the at least one separator pad member to be placed in a stable resting position on at least one loaded filament tube. The at least one separator pad member further may have at least one second aperture disposed therein, for enabling the lower end of at least one filament tube member to be inserted therein, for enabling, in turn, at least one loaded filament tube to be placed in a stable resting position upon the separator pad member. The at least one separator pad is preferably substantially planar in configuration.

A top cap member is operably positionable upon an upper end of at least one filament tube member, and may have at least one first aperture disposed therein for enabling the upper end of at least one filament tube member to be inserted therein for enabling, in turn, the top cap member to be placed in a stable resting position on at least one loaded filament tube.

The top cap member may be formed as a substantially planar structure.

The at least one separator pad member may be formed from a single sheet of material having at least two separator pad portions, one having the at least one first aperture therein and the other having the at least one second aperture therein, which single sheet is foldable so that the at least one first and second apertures may be substantially aligned with one another in overlying relationship to one another.

The at least one first and second apertures of the at least one separator pad member may have substantially the same diameters. Alternatively, the at least one first and second apertures may have different diameters.

The bottom pad member may be formed as a substantially planar member. The bottom pad member may be formed from a plurality of layers of sheet material.

The top cap member may be formed from a plurality of layers of sheet material.

The filament tube shipping apparatus may further comprise a pallet portion, operably associated with the bottom pad member, for facilitating handling and transportation of the filament tube shipping apparatus. The pallet portion preferably comprises at least one top deck member, operably configured to enable the bottom pad member to be placed thereon. A plurality of core members may be operably arranged about an underside of the at least one top deck member, so that the at least one top deck member is positioned atop the upper ends of each of the core members. At least one bottom deck member may operably connect the bottom ends of at least two of the core members.

The filament tube shipping apparatus may be fabricated from paperboard material.

Means for facilitating wrapping the filament tube shipping apparatus with a wrapping material may be provided. The means for facilitating wrapping thereof with a wrapping material comprises each of the bottom pad member, the at least one separator pad member, the top cap member, and the pallet portion being provided with substantially smooth, substantially rounded corners and substantially smooth, substantially straight edges substantially tangential thereto.

In an alternative embodiment of the present invention, the filament tube shipping apparatus means for substantially precluding lateral slipping of one shipping apparatus, when one shipping apparatus is stacked atop another shipping apparatus, during movement of same.

The means for substantially precluding lateral slipping may comprise one or more apertures disposed in an upper surface of the top cap member. One or more support members may be operably associated with and emanate downwardly from, the bottom pad member. Upon placement of one loaded filament tube shipping apparatus atop another loaded filament tube shipping apparatus, at least a portion of at least one of the one or more support members is operably positioned to engage an edge of at least one of the one or more apertures, to provide an interference engagement between the upper and lower loaded filament tube shipping apparatus to substantially inhibit sliding of the upper loaded filament tube member relative to the lower loaded filament shipping tube apparatus.

BEST MODE FOR CARRYING OUT THE INVENTION

Figure 1:
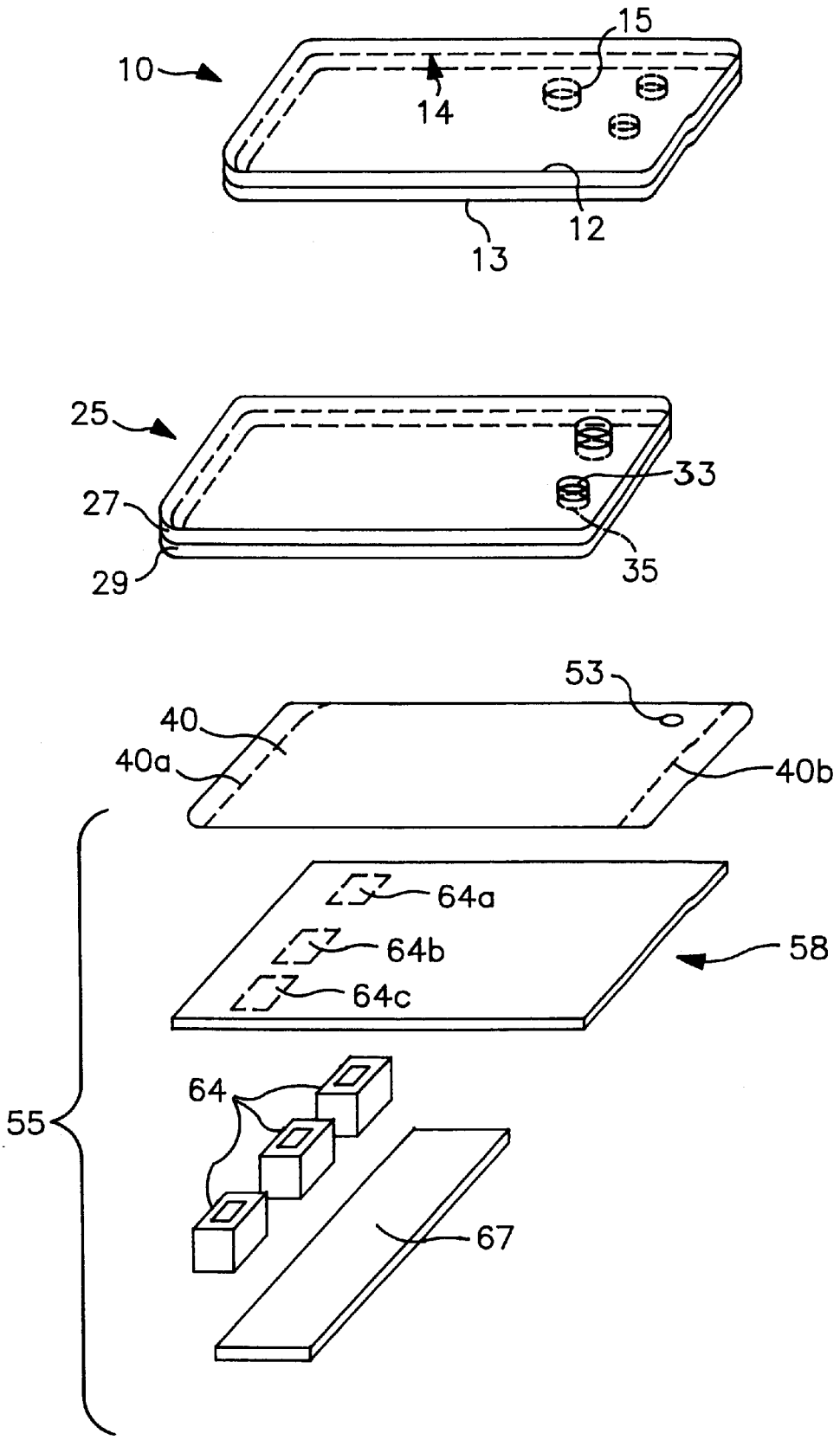
FIG. 1 is an exploded perspective view of a filament tube shipping apparatus according to a preferred embodiment of the present invention.

While this invention is susceptible of embodiment in many different forms, there are shown in the drawings and will be described herein in detail, several embodiments with the understanding that the present disclosure is intended to be considered an exemplification of the principles of the invention and is not intended to limit the invention to the embodiments illustrated.

FIG. 1 shows an exploded perspective view of the elements making up a filament tube shipping apparatus according to one embodiment of the present invention. Filament tube shipping apparatus includes top cap 10, one or more separator pads 25, and a bottom pad/pallet structure 55. Pallet structure 55 includes bottom pad 40, top deck 58, a plurality of cores 64 (three of which are shown, the rest being omitted to simplify the illustration) and one or more bottom deck members 67.

Figure 2:
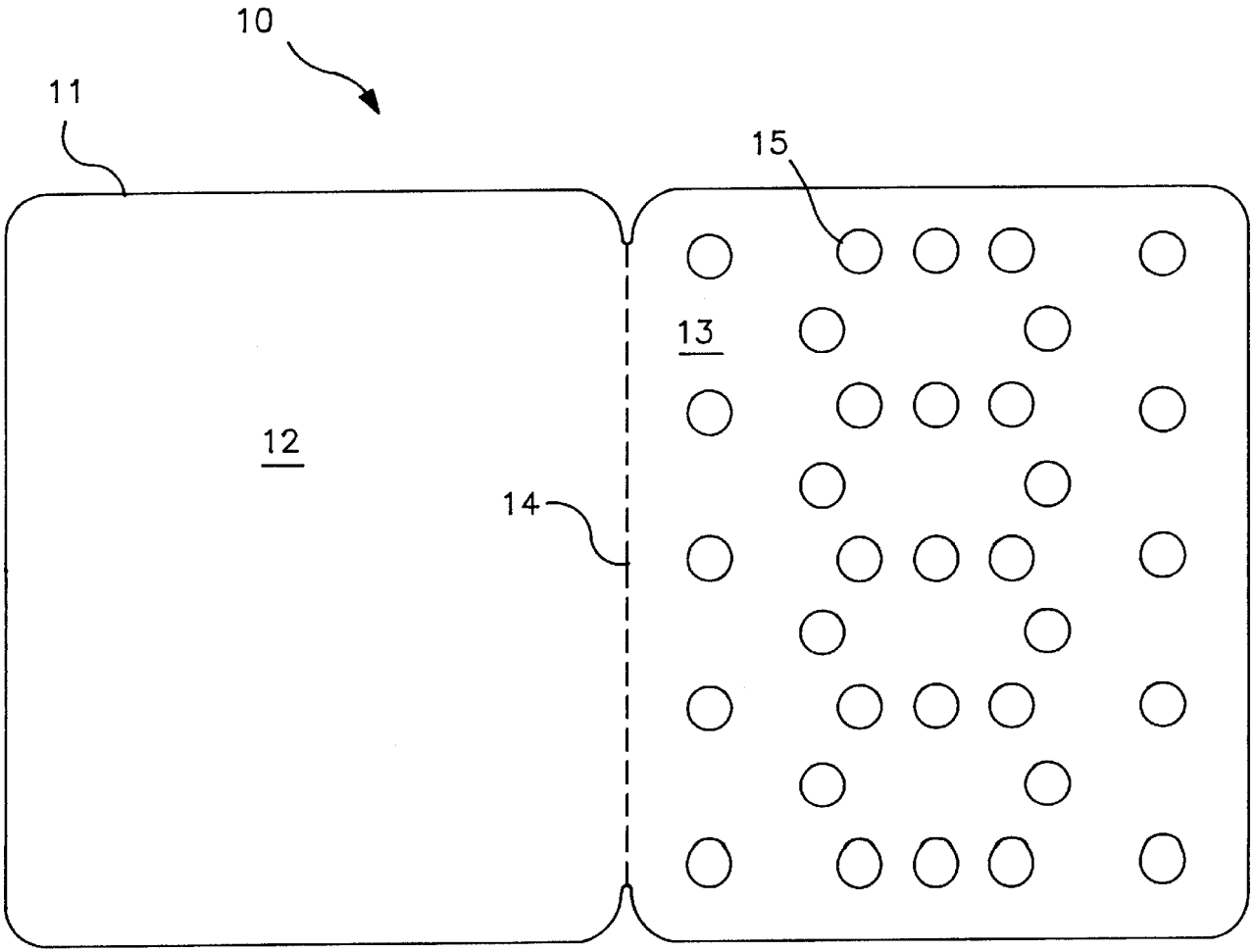
FIG. 2 is a plan view of from the inside of a blank for forming the top cap for a filament tube shipping apparatus according to the embodiment of FIG. 1.

Top cap 10 preferably is formed from a blank 11 (see FIG. 2), which includes two substantially rectangular (or square) halves 12 and 13, each having rounded (as shown), or alternatively, diagonal, corners. Halves 12 and 13 are preferably of substantially the same size and shape. A line of weakness 14, such as a crease, score line or line of perforations, or a combination thereof, separates the halves, to permit folding of one half over the other. A plurality of apertures 15 are disposed in half 13, and extend completely therethrough. For purposes of facilitating illustration, only a few of the apertures 15 are shown in FIG. 1. The pattern in which the apertures 15 are laid out may vary from apparatus to apparatus, depending upon the size and number of loaded filament tubes which are to be shipped. A representative pattern of apertures 15 is shown in FIG. 2

Preferably, blank 11 is fabricated from corrugated paperboard material, which may have a single layer of corrugated medium surrounded on each side by one or more layers of sheet material, such as kraft paper. Alternatively, heavier grades of corrugated paperboard, having multiple layers of corrugated medium separated by sheet material, may be used to form blank 11. As a further alternative, other types of sheet material, such as cardboard, etc., could be used, providing such alternative materials possess the desired handling characteristics to achieve the structures and performance described herein.

Assembly of top cap 10 is accomplished by folding the blank 11 along the line of weakness 14 so that halves 12 and 13 overlie one another substantially congruently. A suitable adhesive is placed on one or both of the halves so that upon folding, the facing surfaces of the respective halves will adhere to one another, to keep blank 11 in the folded configuration.

Figure 3:
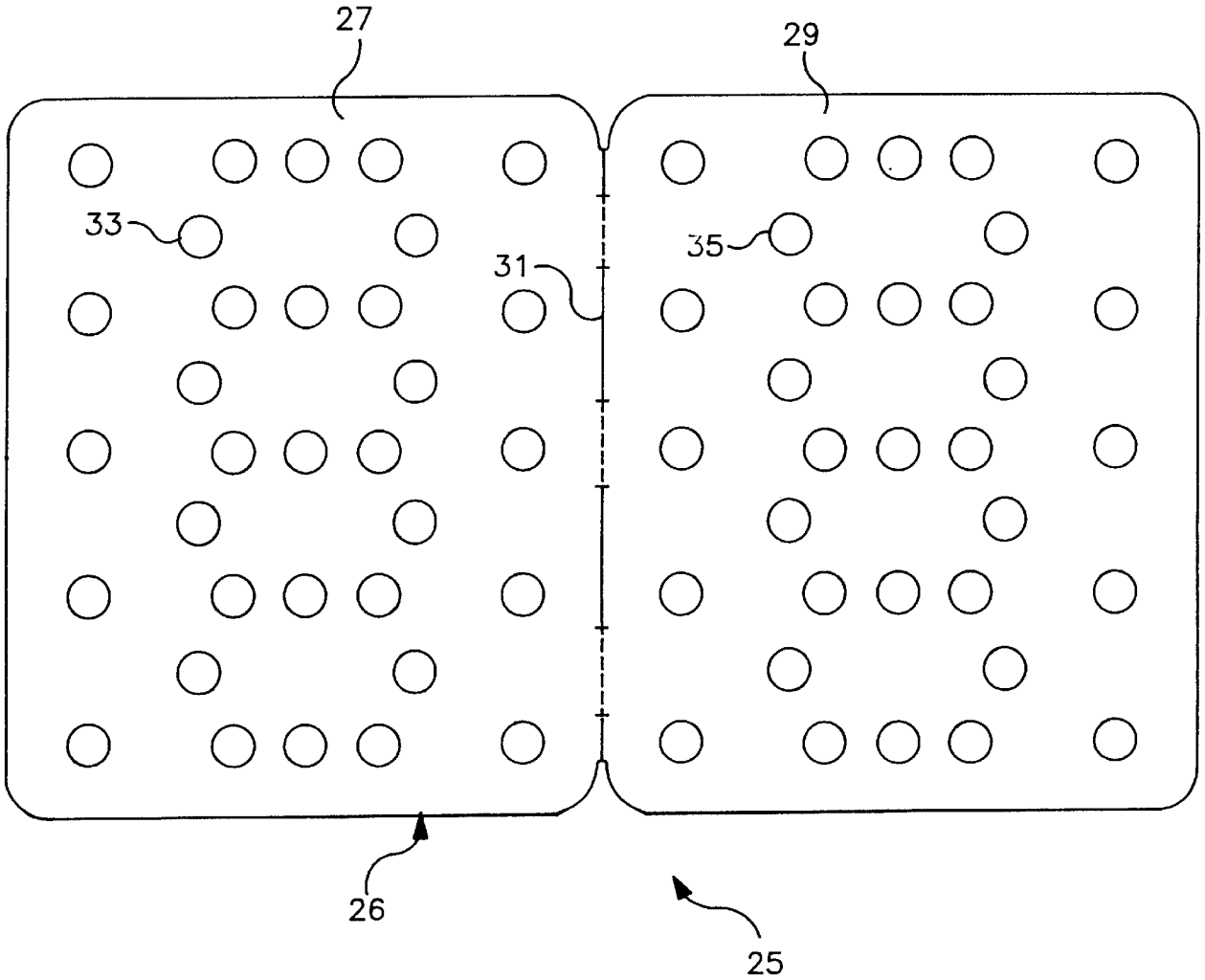
FIG. 3 is a plan view from the inside of a blank for forming one of the separator pads for the filament tube shipping apparatus of FIG. 1.

A filament tube shipping apparatus in accordance with principles of the present invention, so long as it includes more than one layer of loaded filament tubes, will require at least one separator pad 25. As illustrated in FIGS. 1 and 3, each separator pad 25 preferably will be formed from a blank 26 having two halves 27 and 29. A line of weakness 31, such as a crease, score line or line of perforations, or combinations thereof, separates the halves, to permit folding of one half over the other. Apertures 33 and 35 are disposed in halves 27 and 29, respectively, and extend completely therethrough. For purposes of facilitating illustration, only a few of the apertures 33, 35 are shown in FIG. 1. The pattern in which the apertures 33, 35 are laid out may vary from application to application, depending upon the size and number of loaded filament tubes which are to be shipped. A representative pattern of apertures 33, 35 is shown in FIG. 1.

Preferably, blank 26 is fabricated from corrugated paperboard material, which may have a single layer of corrugated medium surrounded on each side by one or more layers of sheet material, such as kraft paper. Alternatively, heavier grades of corrugated paperboard, having multiple layers of corrugated medium separated by sheet material, may be used to form blank 26. As a further alternative, other types of sheet material, such as cardboard, etc., could be used, providing such alternative materials possess the desired handling characteristics to achieve the structures and performance described herein.

Each of halves 27 and 29 preferably will be provided with rounded corners. Alternatively, diagonal corners may be provided, so long as sharp edges and pointed corners are avoided.

Separator pad 25 is shown in FIG. 3 in its unarticulated configuration. Separator pad 25 may be used with filament tube shipping apparatus for transporting filament tubes which have either cylindrical or conical filament tube members.

The sizing, spacing and pattern of the apertures 33 and 35 may be varied in accordance with the configuration(s) of the filament tube members which will be used, the ultimate dimensions of the loaded filament tubes which are being contemplated, and the number of loaded filament tubes which are contemplated as being in a particular fully assembled package. Accordingly, the sizing, spacing and pattern of the apertures 33 and 35 may be readily modified by one of ordinary skill in the art having the present disclosure before them. Apertures 33 and 35 may have the same diameter; alternatively, they may have different diameters, with the larger diameters on the "upper" side of the folded separator pads, for accommodating conical filament tubes. In such an alternative embodiment, the larger apertures will be greater than the diameter of the bottoms of the conical filament tubes, while the smaller apertures will be smaller than the bottoms of the conical filament tubes. The tubes would then be able to rest upon the separator pads, on the material surrounding the smaller apertures.

The configuration of separator pads 25 is advantageous in that it avoids the necessity of making laminated separator pads, from completely separate unattached sheets, which would have to be aligned, and then affixed to one another such as by gluing. The fold-over configuration provides for the automatic alignment of the apertures in the two halves, which, in turn, facilitates the articulation and assembly of the entire filament tube shipping apparatus by automated means, such as robotic devices.

In an alternative embodiment of the invention, the separator pads could be formed from a single thickness of unfolded sheet material, which may be several layers thick, e.g., multiwall corrugated paperboard material.

Figure 4:
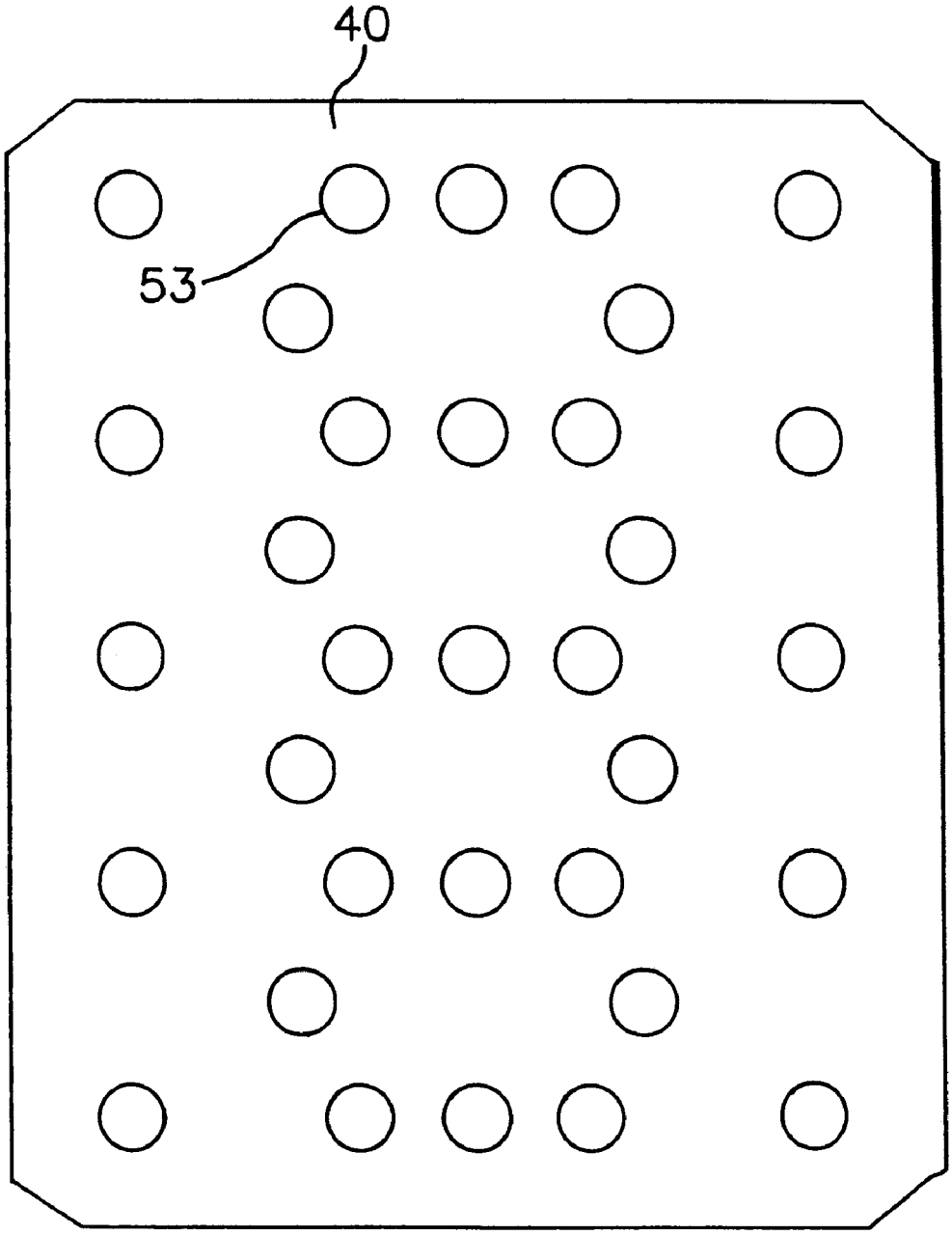
FIG. 4 is a plan view of a blank for forming the bottom pad for the filament tube shipping apparatus of FIG. 1.

FIG. 4 is a plan view of bottom pad 40. Bottom pad 40 preferably is formed from a single sheet of material (which may have several layers), which has a pattern of apertures 53 (only one of which is shown in FIG. 1), which may be the same size as apertures 33 in separator pad half 27, and which may have the same pattern to the array, in order to accommodate the bottom ends of the filament tube members of the bottom-most layer of loaded filament tubes. The dimensions of bottom pad 40 may be substantially the same as separator pad half 27. Bottom pad 40 may be provided with rounded corners or diagonally cut corners.

Bottom pad 40 may typically be formed from "single wall" corrugated paperboard material. Alternatively, heavier grades of corrugated paperboard, having multiple layers of corrugated medium separated by sheet material, or other types of sheet material, such as cardboard, etc., could be used, providing such alternative materials possess the desired handling characteristics to achieve the structures and performance described herein.

Pallet structure 55, which is used to support and form part of the filament tube shipping apparatus, also includes top deck 58, a plurality of cores 64, and a plurality of bottom deck members 67. Top deck 58 may be fabricated from corrugated paperboard material, having a single layer of corrugated medium surrounded on each side by one or more layers of sheet material, such as kraft paper. Alternatively, heavier grades of corrugated paperboard, having multiple layers of corrugated medium separated by sheet material, may be used to form top deck 58. As a further alternative, other types of sheet material, such as cardboard, etc., could be used, providing such alternative materials possess the desired handling characteristics to achieve the structures and performance described herein.

Preferably, top deck 58 has a length which is less than the length of bottom pad 40. When bottom pad 40 is attached to top deck 58, such as by gluing, the ends of bottom pad 40 will overhang the ends of top deck 58. This is illustrated by the dotted lines 40*a* and 40*b*, which represent schematically, the end edges of top deck 58. The width of top deck 58 may be substantially the same as the width of bottom pad 40.

The corners of top deck 58 may be square, as illustrated. Alternatively, they may be rounded, or diagonally cut.

Preferably, bottom pad 40 will be laminated to top deck 58, with cores 64 and bottom deck members 67 glued in place, in the manner described hereinafter, so that the several components form a single unit which is ready to be loaded, and which may be handled in a facilitated manner, such as by robotic handling devices, e.g., suction gripping devices and so on.

Figure 5:
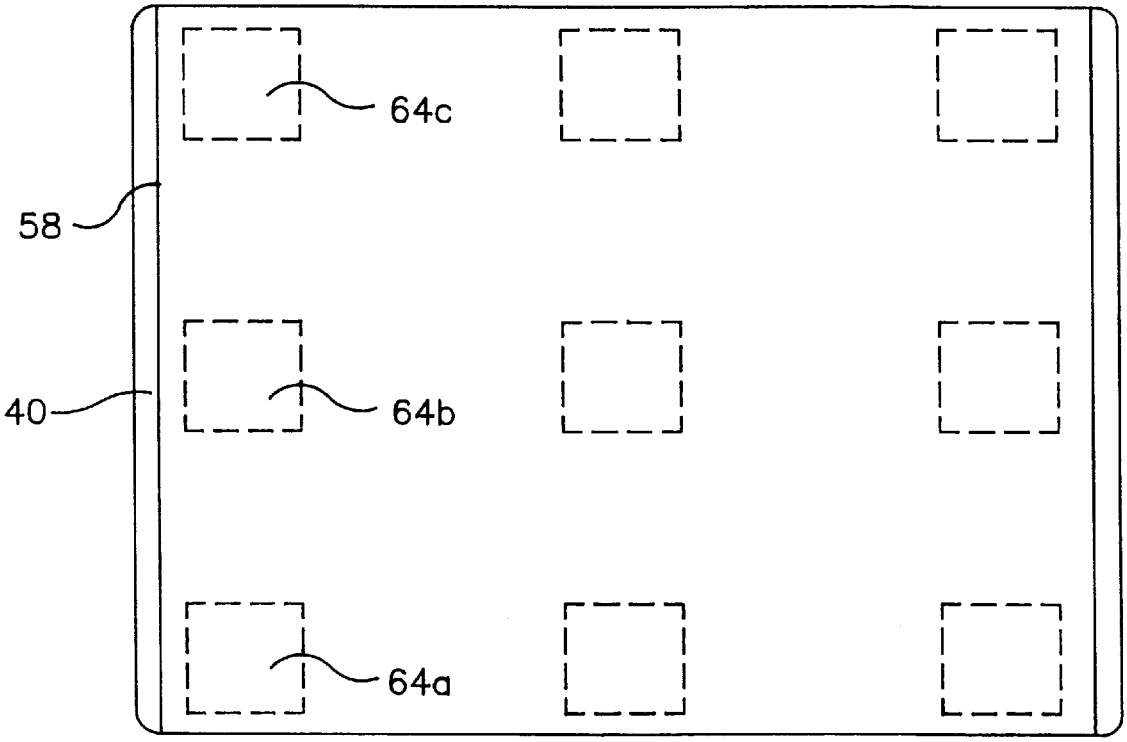
FIG. 5 is a plan view of the underneath of the pallet portion of the filament tube shipping apparatus.

In one preferred embodiment, bottom pad 40 and top deck 58 are two separate components which are juxtaposed and affixed together such as by gluing, as shown and described with respect to FIGS. 1, 4 and 5. In an alternative embodiment (not shown), the bottom pad and the top deck may be formed from a single blank, having two nonidentical halves, separated by a line of weakness, which is folded and the halves affixed to one another, in a manner similar to that described with respect to the top cap and the separator pad(s). However, unlike the top cap or separator pad(s), the bottom pad and the top deck would not necessarily have the same overall dimensions.

A plurality of cores 64 may be glued to the underside of top deck member 58 (or otherwise affixed), in a rectangular array. For simplicity of illustration, only one column of cores, and their contemplated positions (64*a*, 64*b*, 64*c*) are shown in FIG. 1. However, it is to be understood that at least two and possibly several columns of cores will be provided, spaced along the length or width of top deck member 58. FIG. 5, for example, shows the underside of top deck member 58, and depicts nine locations for the placement of cores 64. The end cores of each column or row may be spaced away from the adjacent edge(s) of top deck member 58, so that there would be some overhang of top deck 58, relative to the array of cores, around the complete periphery of top deck 58. Alternatively, the cores could be positioned adjacent the end edges of top deck 58, since, as indicated by lines 40*a* and 40*b*, there would still be some spacing left between the cores and the end edges of bottom pad 40.

Each core 64 may be formed as a square, rectangular, round, oval or other shaped coil of material. Double wall corrugated paperboard may be used, as could other types of sheet material, such as cardboard, etc., providing such alternative materials possess the desired handling characteristics. In addition to being glued or otherwise affixed to top deck 58, a bottom deck member 67 is glued to the bottoms of a row/column of cores 64, so as to create, in effect, at least two runner structures. The runner structures will be spaced apart, to enable the tines of a forklift or pallet jack to be inserted between or around the runners. Preferably, each bottom deck member 67 has a length which is less than the width of top deck member 58, so that the runner formed by cores 64 and bottom deck members 67 have lengths which are less than the width of top deck 58, again, to provide the overhang of top deck 58 that has been previously described.

Alternatively, bottom deck members 67 may have lengths which are substantially the same as the width of top deck 58 and/or bottom pad 40.

In a preferred embodiment of the invention, top cap 10, separator pads 25 and bottom pad 40, in addition to the various components making up pallet structure 55, are all formed from corrugated paperboard material.

To load a filament tube shipping apparatus constructed in accordance with the elements of FIG. 1, first a pallet device 55 is positioned at a loading position. A bottom pad 40, is positioned and affixed, e.g., by gluing, atop top deck 58. The bottom ends of the filament tube members of a first layer of loaded filament tubes are located in the holes as desired and dictated by the pattern of apertures on bottom pad 40. The apertures 53 preferably will be deep enough that the filament tube members will not bottom out, but will permit the wound material to rest directly on bottom pad 40. If apertures 53 are not deep enough, and the bottoms of the tubes do "bottom out", then, typically, as layers are added, the combined weight will tend to cause the tubes of the bottom layer to compress the material of top deck 58, in the area of contact of the bottoms of the tubes, until the wound material eventually rests atop bottom pad 40.

A separator pad 25, which has been previously folded along fold line 31 and glued together, is placed atop the upper ends of the filament tube members of the layer of loaded filament tubes so that apertures 35 align with and fit over the top ends of the filament tube members of the first row of loaded filament tubes. The pad will "sit" directly atop the wound material of the filled filament tubes. Separator pad half 27 will be "facing up" with apertures 33 ready to receive the lower ends of the filament tube members for the next layer of loaded filament tubes.

This stacking procedure will continue until the desired number of layers of loaded filament tubes (dictated either by the design parameters of the particular structure and/or the total number of loaded filament tubes to be shipped, if a lesser number) is reached. A top cap 10 is then positioned on the upper most layer of loaded filament tubes, in the manner similarly described.

To complete the packaging process, strapping members, fabricated from metal and/or plastic, may be wrapped around the entire assembly (extending across the top of the top cap and across the underside of the pallet structure, between the runners), after the pallet has been raised by a pallet jack or forklift. After the straps have been positioned, then a plastic wrapping material 75 (see FIG. 8*a*) may be placed around the circumference of the entire structure, using otherwise conventionally known wrapping techniques. Typically the wrap will be a self-clinging stretch wrap material.

Figure 6A:
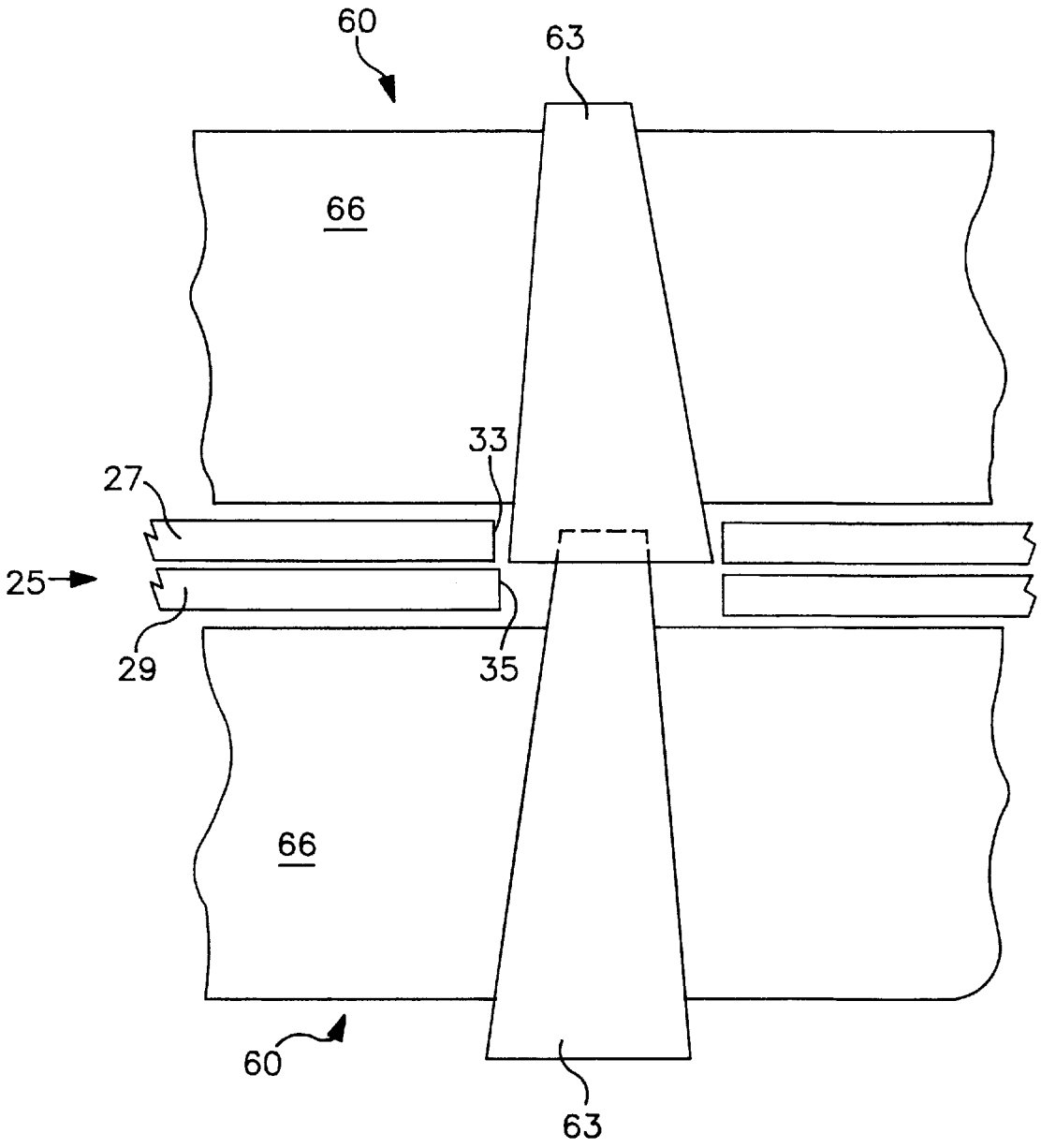
FIG. 6*a* is a schematic side elevation showing the interrelation of adjacent layers of loaded filament tubes and the operation of the separator pad therebetween.

FIG. 6*a* illustrates the cooperation and stacking of one layer of loaded filament tubes atop another in a filament tube shipping apparatus in accordance with the principles of the present invention. A lower loaded filament tube 60 includes filament tube member 63 and yarn 66. The lower loaded filament tube 60 may be resting upon bottom pad 40 or it may be resting upon a separator pad 25 (not shown). The separator pad 25 that is shown has been folded so that pad half 27 is up and pad half 29 is down, relative to the vertical orientation of the stacked filament tubes. Aperture 35 receives the upper, narrow end of lower filament tube member 63. Aperture 33 receives the lower, wider end of filament tube member 63 of upper filament tube 60. Depending upon the lengths of filament tube members 63 and the amount of uncovered tube at the top and bottom of each filament tube member 63, the upper end(s) of lower filament tube member(s) 63 may actually be partially inserted into the bottom end(s) of upper filament tube member(s) 63. In addition, the thicknesses of pad halves 27, 29 preferably are such that the actual yarn 66 of a filament tube 66 rest upon the separator pad or bottom pad immediately below it. FIG. 6*a* is not to scale. It is understood that halves 27, 29 will be substantially touching, with a layer of adhesive material between them. Further, the lower surface of half 29 will be resting on the yarn material 66 of the lower loaded filament tube 60.

Figure 6B:
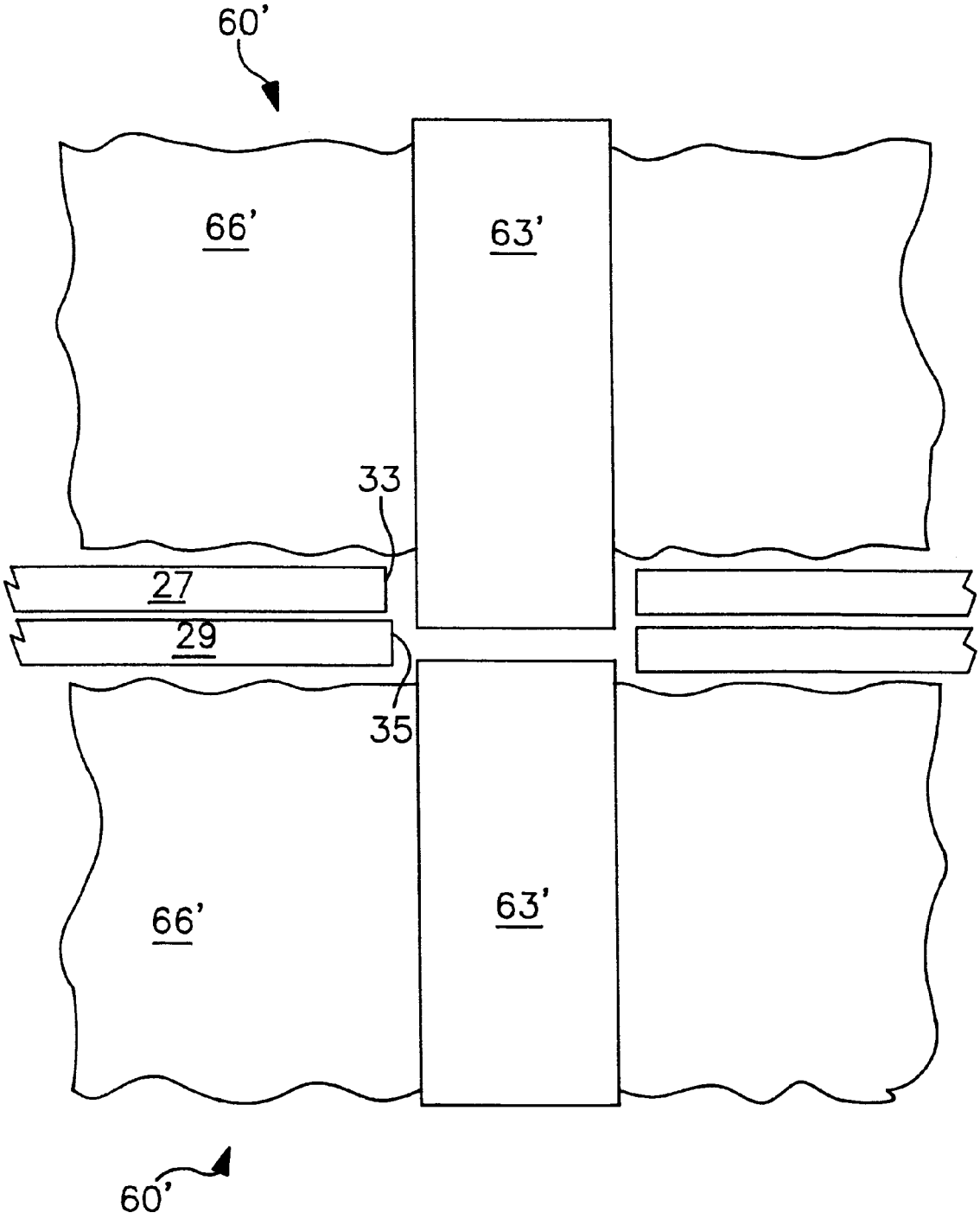
FIG. 6*b* is a schematic side elevation showing the interrelation of adjacent layers of loaded filament tubes and the operation of the separator pad therebetween.

In an embodiment of the filament tube shipping apparatus which is configured for filament tubes having substantially exactly cylindrical spool members (FIG. 6*b*), the thicknesses of separator pad halves 27 and 29 will be such that the top ends of one layer of loaded filament tubes will preferably be slightly vertically spaced from the bottom ends of the loaded filament tube members of the immediately vertically adjacent row of loaded filament tubes. FIG. 6*b* is not to scale. It is understood that halves 27, 29 will be substantially touching, with a layer of adhesive material between them. Further, the lower surface of half 29 will be resting on the yarn material 66 of the lower loaded filament tube 60'.

In addition, it may be desired that the yarn or other filament of the filament tubes of the bottom-most layer rest on the upper surface of bottom pad 40. Accordingly, the thickness of bottom pad 40 may be such that the bottom ends of the filament tubes will dwell in apertures 53, substantially without "bottoming out" against the upper surface of top deck 58, in order to permit the wound filament to rest on bottom pad 40.

The filament tube shipping apparatus of both embodiments have advantageous features. First, no sharp (e.g., right-angle) corners are present, which enables rapid wrapping of a loaded shipping apparatus with plastic wrapping material, with reduced likelihood of puncturing or tearing of the plastic wrapping material. In addition, since the bottom pad and/or top deck of the pallet structure overhangs the runner structures, at least in part, the wrapping material can be shrunk or curled around this overhang, helping hold the wrapping material "down" and preventing upward "creeping" of the wrapping material during shipment.

The filament tube shipping apparatus of the present invention, in particular the embodiment of FIGS. 1–6, are configured for facilitated loading and wrapping, for example by automated robotic equipment, thus enabling faster more economic loading and shipping of such materials. The substantially flat top cap structure, which is intended to be pre-folded and glued prior to the packaging procedure, can be arranged in stacks and readily handled by automated machinery (e.g.) suction-cup type handlers, without requiring manual assembly of the top cap structure(s) during the actual packaging process. Similarly, no tray-type bottom cap is employed. The provision of separate runner structures in the pallet structure, in addition to facilitating the use of forklifts or similar devices, further facilitates the binding of the stack with straps, by providing convenient locations for the straps to pass under the shipping apparatus, with less likelihood of crushing, bending or tearing the loaded, reinforced bottom pad/top deck structure. Prior art corrugated shipping apparatus had large, undivided skid sheets which often became crumpled, torn or bent by the strapping process, thus weakening the pallet structure and potentially producing instability.

Figure 7:
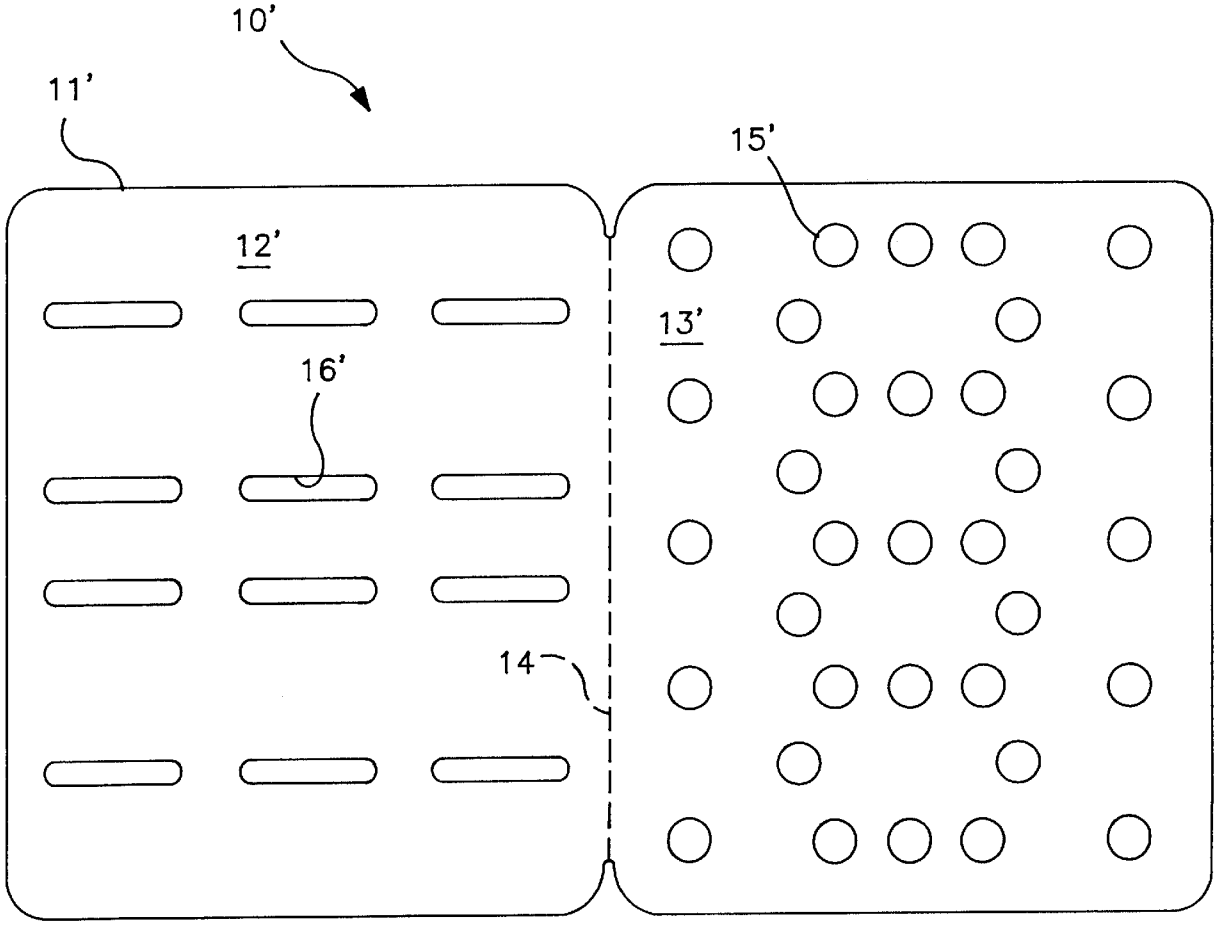
FIG. 7 is a plan view of from the inside of a blank for forming the top cap for a filament tube shipping apparatus according to an alternative embodiment of the invention.

In an alternative embodiment of the invention, the top cap may be provided with slots in the half of the blank opposite that which has the round apertures. FIG. 7 illustrates the blank 11' for the alternative top cap 10', which has halves 12' and 13'. Apertures 15' are provided in half 13'. In addition, slip-slots 16 are provided to help promote stability of the packaged shipping apparatus during handling.

In typical shipping and handling procedures, stacked, strapped and wrapped filament tube packages are moved, e.g., by forklift, two at a time, one atop the other, and may be stacked even higher, in trucks or rail cars. During handling by forklift, or possibly even during actual transit, there is a tendency for the top-most wrapped package to shift or slide about on the top of the package below it. The slip-slots 16 provided in the alternative embodiment of the present invention help prevent such slippage. The slip-slots 16 are located on the upper surface of the top cap (half 12'), when the top cap is folded and glued together and positioned. The slip-slots are arranged in a pattern in which the slip-slots will be slightly laterally offset relative to the runners in the loaded package which is set on top of it. In particular, the slip-slots may be placed so that the edges of the runners of the loaded package above will be positioned generally adjacent the slip-slots of the package below. Because of the substantial weight of such a loaded package (e.g., several hundreds of pounds or more), the runners of the top package will compress portions of the upper surface of the top cap of the lower package. The edges of the runners of the upper package will then engage the edges of the slip-slots of the lower package, upon slight shifting of the top package relative to the bottom package, thus creating an interference resistance to slippage of the top package relative to the bottom package, promoting enhanced stability during handling and transit.

Figure 8:
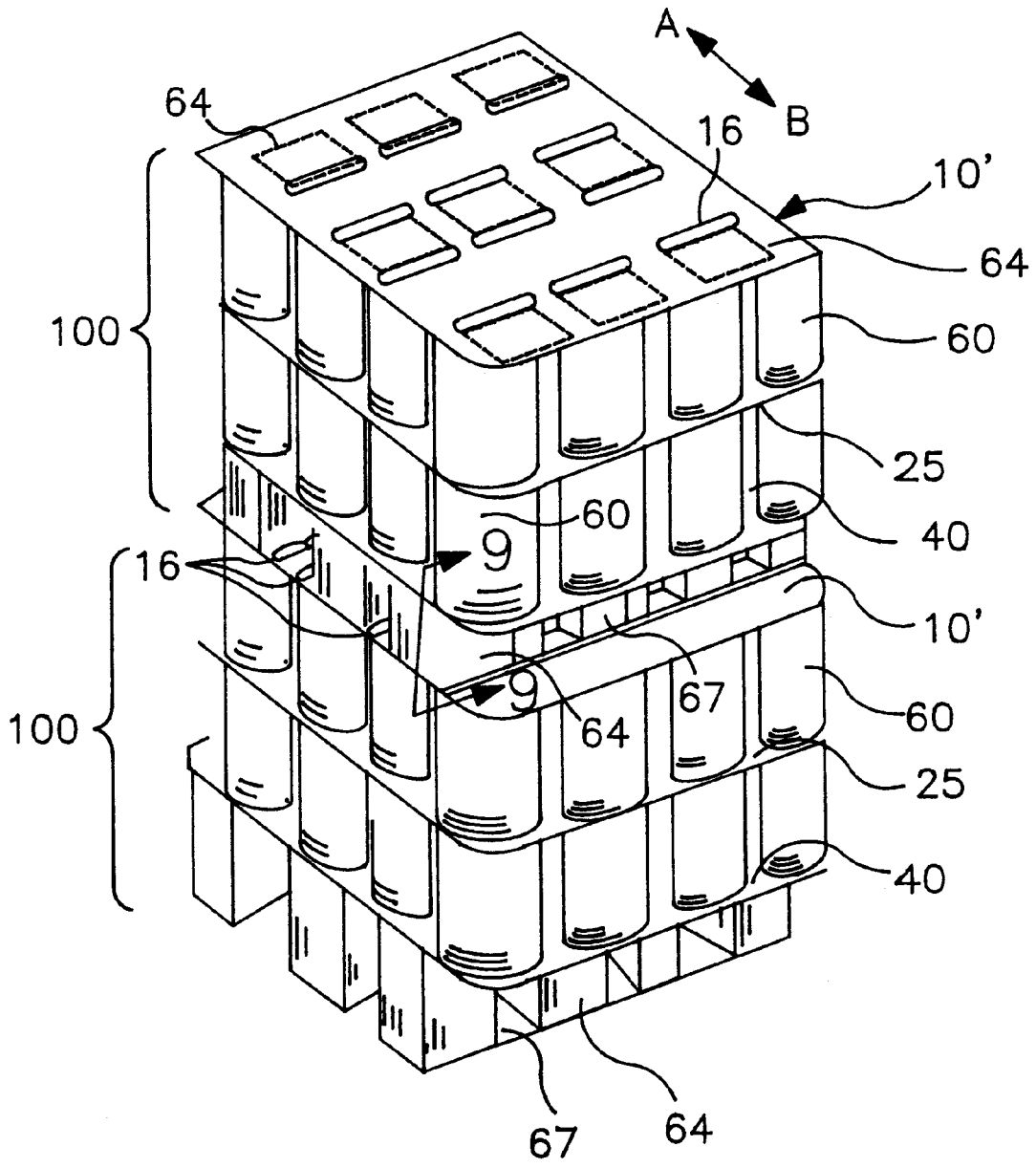
FIG. 8 is a perspective view of two stacked loaded shipping apparatus according to the alternative embodiment of FIG. 7 of the present invention.
Figure 8A:
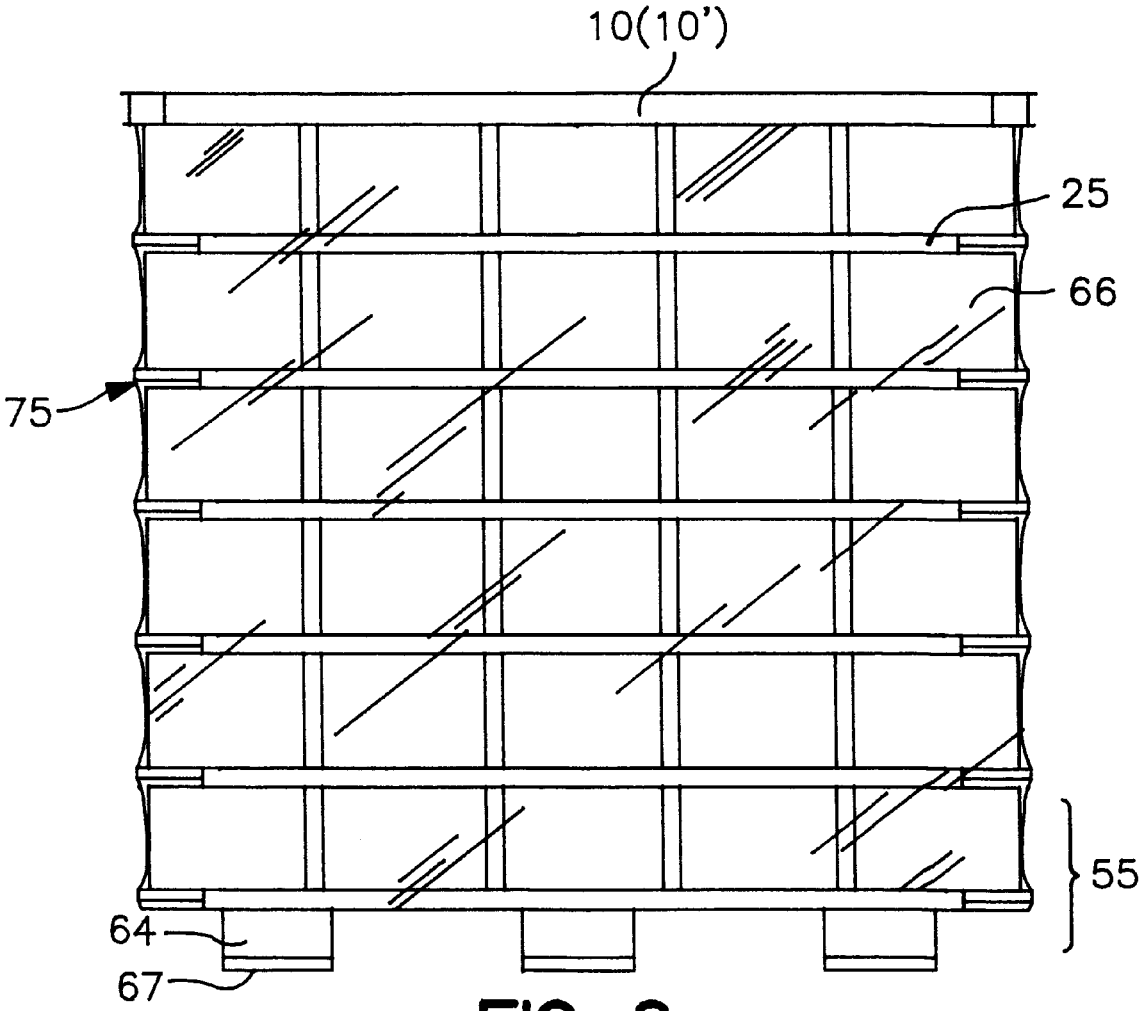
FIG. 8*a* is a side elevation of a loaded wrapped filament tube shipping apparatus.
Figure 9:
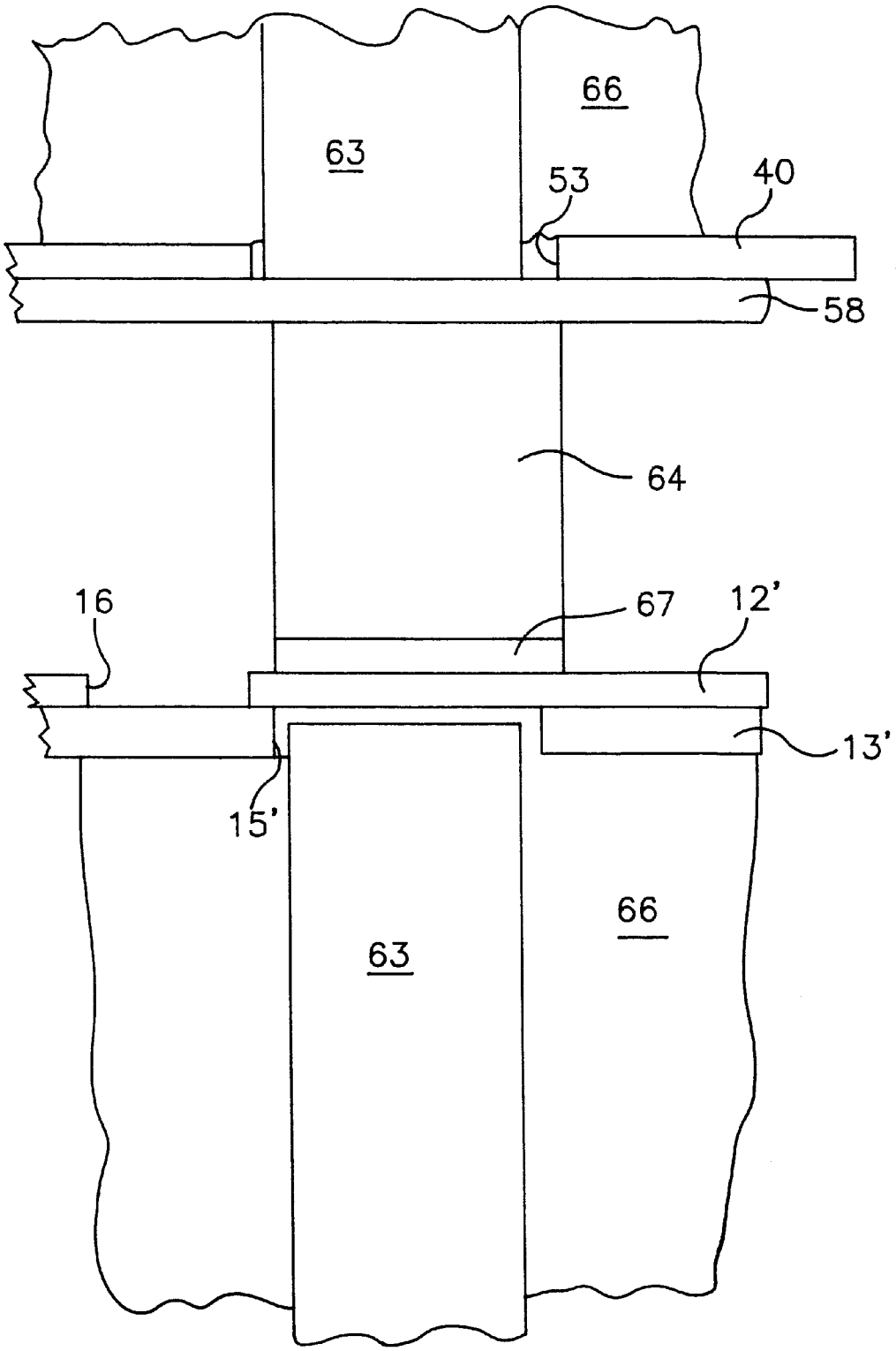
FIG. 9 is a fragmentary sectional view taken along line 9—9 of FIG. 8.

This mechanism is illustrated in FIGS. 8 and 9. Two loaded shipping apparatus 100 are stacked one atop the other. The wrapping has been omitted to simplify the illustration. Each apparatus 100 has two layers of loaded filament tubes 60. Each apparatus 100 includes a top cap 10' with slip-slots 16. FIG. 9 is a fragmentary sectional view taken along line 9—9 of FIG. 8, a sectional elevation along a vertical plane cutting substantially through the center of the corner filled filament tube. In the lower shipping apparatus, the slip-slots 16 are positioned in top cap 10' to be slightly laterally offset from the runner structures of the shipping apparatus immediately above. The bottom deck members 67 of the upper shipping apparatus compress the edges of the slip-slots 16, so that the edges of the deck member 67 are lower than portions of the edges of the slip-slots 16, to create an interference engagement, providing resistance to relative lateral movement. When a stack of two filled shipping apparatus are lifted, such as by forklift, the stack is tilted slightly. Shifting of the top shipping appparatus may occur in the A-B direction as indicated by the arrow in FIG. 8. After a slight amount of shift, the edges of the deck members 67 will catch the edges of one or more of the slip-slots 16, and prevent further relative slippage. The positioning of cores 64, relative to the slip-slots 16, were a further filled package to be stacked on the top package in FIG. 8, is indicated in broken lines.

The blank for top cap 10' is preferably configured so that when folded, slip-slots 16 do not overly apertures 15', so that fall-through of dirt, etc., is substantially precluded.

It is believed that the concentrated weight in the smaller area of the runner structures, relative to the overall footprint of the shipping apparatus, permits the slip slots to be effective. However, the specific configuration of the runner structures may be modified, and still provide the anti-slip feature, so long as a reduced surface area is present.

In an alternative embodiment of the invention (not shown), the apertures of one of halves 27, 29 may be larger than the apertures of the other of the halves. Such an embodiment would be useful for filament tubes which are conical. Upon folding of the separator pads, the smaller apertures would be facing down, to fit onto the narrow ends of the conical filament tubes. The larger apertures would be facing upward to receive the large ends of the next layer of conical filament tubes. The tubes of each layer would be provided with back-up support by the material of the (lower) pad half surrounding the smaller apertures on the lower side of the pad. In conjunction with such separator pads, the top cap could be provided with smaller apertures, and the bottom pad would typically be provided with larger apertures.

Although the patterns of the apertures in the top cap, separator pad(s) and bottom pad may vary from layer to layer, typically the pattern and hole size will be the same in each layer. In this manner, the loaded filament tubes of the several layers are aligned vertically, to provide uniform load distribution throughout the stack. This helps to prevent bending or buckling of the separator pad(s) and/or bottom pad which might otherwise occur.

The foregoing description and drawings merely explain and illustrate the invention and the invention is not limited thereto except insofar as the appended claims are so limited, as those skilled in the art having the disclosure before them will be able to make modifications and variations therein without departing from the scope of the invention.

We claim:

1. A filament tube shipping apparatus, for the facilitated packaging and transportation of a plurality of filament tube members, each having a quantity of elongated filament material wound thereon to form loaded filament tubes, the filament tube shipping apparatus comprising:

a bottom pad member, having a plurality of apertures disposed therein, for insertably receiving, respectively the lower ends of the plurality of filament tube members, for enabling, in turn, the plurality of loaded filament tube members to be placed in a stable resting position upon the bottom pad member;

at least one separator pad member, operably positionable upon the plurality of loaded filament tube members;

the at least one separator pad member having a plurality of first apertures disposed therein for insertably receiving the upper ends of the plurality of filament tube members, respectively, for enabling, in turn, the at least one separator pad member to be placed in a stable resting position upon the plurality of loaded filament tube members, the at least one separator pad member further having a plurality of second apertures disposed therein, for insertably receiving the lower ends of another plurality of loaded filament tube members, for enabling, in turn, the another plurality of loaded filament tube members to be placed in a stable resting position upon the separator pad member, the at least one separator pad member being substantially planar in configuration;

a top cap member, operably positionable upon upper ends of the another plurality of filament tube members, and having a plurality of first apertures disposed therein for insertably receiving the upper ends of the another plurality of filament tube members, respectively, for enabling, in turn, the top cap member to be placed in a stable resting position on the another plurality of loaded filament tube members, the top cap member being formed as a substantially planar structure; and a pallet, operably configured for supporting the bottom pad member, at least one separator pad member, said top cap member and at least two pluralities of filled filament tube members, and further operably configured for handling by conventional tined material handling devices, the pallet including a top deck, a plurality of vertical support members operably depending from the top deck and at least one bottom deck operably affixed to at least one of said vertical support members, said vertical support members providing spacing between the top deck and the at least one bottom deck, to permit the insertion of the tines of a conventional tined material handling device:

each of the upper and lower ends of at least one filament tube member in each of said at least two pluralities of filled filament tube members being insertably received in an aperture in one of the bottom pad member, the at least one separator pad member and the top cap member, respectively, so that the filaments of the loaded filament tubes are in direct, load bearing contact with at least one of the bottom pad member, and the at least one separator pad member, respectively: and means for substantially precluding lateral slipping of said shipping apparatus relative to another said shipping apparatus, when the another one of said apparatus is stacked atop said shipping apparatus, said means including at least one substantially elongated cut-away portion disposed in an upper surface of the top cap member, operably configured to engage, at least indirectly, an edge of the at least one bottom deck of the another said shipping apparatus, to provide an interference engagement therebetween to substantially inhibit sliding of an upper loaded filament tube shipping apparatus relative to a lower loaded filament shipping tube apparatus.

2. The filament tube shipping apparatus according to claim 1, wherein the at least one separator pad member is formed from a single sheet of material having at least two separator pad portions, one having the at least one first aperture therein and the other having the at least one second aperture therein, which single sheet is foldable so that the at least one first and second apertures may be substantially aligned with one another in overlying relationship to one another.

3. The filament tube shipping apparatus according to claim 1, wherein the at least one first and second apertures of the at least one separator pad member have substantially the same diameters.

4. The filament tube shipping apparatus according to claim 1, wherein the at least one first and second apertures of the at least one separator pad member have substantially different diameters.

5. The filament tube shipping apparatus according to claim 1, wherein the bottom pad member is formed as a substantially planar member.

6. The filament tube shipping apparatus according to claim 5, wherein the bottom pad member is formed from a plurality of layers of sheet material.

7. The filament tube shipping apparatus according to claim 1, wherein the top cap member is formed from a plurality of layers of sheet material.

8. The filament tube shipping apparatus according to claim 1, wherein the filament tube shipping apparatus is fabricated from paperboard material.

9. The filament tube shipping apparatus according to claim 1, further comprising means for facilitating wrapping thereof with a wrapping material.

10. The filament tube shipping apparatus according to claim 9, wherein the means for facilitating wrapping thereof with a wrapping material comprises each of the bottom pad member, the at least one separator pad member, the top cap member, and the pallet portion being provided with substantially smooth, substantially rounded corners and substantially smooth, substantially straight edges substantially tangential thereto.

* * * * *

UNITED STATES PATENT AND TRADEMARK OFFICE

CERTIFICATE OF CORRECTION

PATENT NO. : 5,924,569
DATED : July 20, 1999
INVENTOR(S) : Kleinschimdt et al.

It is certified that error appears in the above-identified patent and that said Letters Patent is hereby corrected as shown below:

Column 12,
Lines 28 and 37, delete ":" and insert -- ; --

Signed and Sealed this

Twenty-first Day of May, 2002

*Attest:*

*Attesting Officer*

JAMES E. ROGAN
*Director of the United States Patent and Trademark Office*